US008707524B2

(12) United States Patent
Wang

(10) Patent No.: US 8,707,524 B2
(45) Date of Patent: Apr. 29, 2014

(54) DOUBLE SIDED NYLON SANDWICH MESH FABRIC ZIPPER AND SLIDER ASSEMBLY

(76) Inventor: Lien-Chou Wang, New Taipei (TW)

( * ) Notice: Subject to any disclaimer, the term of this patent is extended or adjusted under 35 U.S.C. 154(b) by 117 days.

(21) Appl. No.: 13/286,287

(22) Filed: Nov. 1, 2011

(65) Prior Publication Data

US 2013/0104348 A1 May 2, 2013

(51) Int. Cl.
*A44B 19/12* (2006.01)
*A44B 19/24* (2006.01)

(52) U.S. Cl.
USPC ..... 24/392; 24/393; 24/394; 24/396; 24/415; 24/426

(58) Field of Classification Search
USPC ..... 24/381, 382, 386, 392, 393, 394, 395, 24/396, 415, 426
See application file for complete search history.

(56) References Cited

U.S. PATENT DOCUMENTS

| | | | | | |
|---|---|---|---|---|---|
| 1,934,084 | A | * | 11/1933 | Murphy | 24/386 |
| 2,229,216 | A | * | 1/1941 | Marinsky | 24/382 |
| 3,136,016 | A | * | 6/1964 | Firing | 24/393 |
| 3,263,291 | A | * | 8/1966 | Taylor | 24/391 |
| 3,283,379 | A | * | 11/1966 | Burbank | 24/392 |
| 3,449,803 | A | * | 6/1969 | Manning | 24/396 |
| 3,454,052 | A | * | 7/1969 | Burbank | 139/384 R |
| 3,490,108 | A | * | 1/1970 | Frohlich | 24/392 |
| 3,579,748 | A | * | 5/1971 | Chery | 24/396 |
| 3,590,881 | A | * | 7/1971 | Van Amburg | 139/384 B |
| 3,768,125 | A | * | 10/1973 | Frohlich | 24/396 |
| 3,783,476 | A | * | 1/1974 | Frohlich | 24/394 |
| 3,855,673 | A | * | 12/1974 | Heimberger | 24/395 |
| 3,925,857 | A | * | 12/1975 | Kihara | 24/427 |
| 4,133,084 | A | * | 1/1979 | Yoshida | 24/393 |
| 4,304,030 | A | * | 12/1981 | Yoshida | 24/392 |
| 4,409,705 | A | * | 10/1983 | Yuunaga | 24/415 |
| 4,455,722 | A | * | 6/1984 | Oda | 24/427 |
| 4,562,622 | A | * | 1/1986 | Takabatake | 24/427 |
| 4,601,085 | A | * | 7/1986 | Yoshida et al. | 24/384 |
| 4,675,950 | A | * | 6/1987 | Tsubokawa | 24/390 |
| 4,718,149 | A | * | 1/1988 | Tsubokawa | 24/392 |
| 5,042,117 | A | * | 8/1991 | Tsubata | 24/381 |
| 5,058,246 | A | * | 10/1991 | Fujisaki et al. | 24/394 |
| 5,596,793 | A | * | 1/1997 | Davis | 24/394 |
| 6,497,015 | B1 | * | 12/2002 | Kato et al. | 24/394 |
| 6,591,463 | B2 | * | 7/2003 | Wang | 24/396 |
| 7,137,177 | B2 | * | 11/2006 | Fujii et al. | 24/433 |

* cited by examiner

*Primary Examiner* — Robert J Sandy
*Assistant Examiner* — David Upchurch
(74) *Attorney, Agent, or Firm* — Jackson IPG PLLC

(57) ABSTRACT

A double sided nylon sandwich mesh fabric zipper and slider assembly includes coil strips being left handed and right handed plastic coils each having a center cord and a series of interlocking teeth, each tooth having a tooth head and a tooth body so configured that the tooth heads are respectively interlockable with the tooth heads of the teeth of the coil strips at the other zipper tape. The slider has C-shaped guide grooves to guide locking and unlocking positions horizontal movement of the teeth of the upper and lower coil strips, and a balance guide block configured to match with the configuration of the tooth heads, facilitating accurate alignment between the left and right teeth of the upper and lower coil strips and assuring smooth engagement and disengagement of the interlocking teeth.

2 Claims, 13 Drawing Sheets

DOUBLE SIDED NYLON SANDWICH MESH FABRIC ZIPPER AND SLIDER ASSEMBLY

BACKGROUND OF THE INVENTION

1. Field of the Invention

The present invention relates to zippers and more particularly, to a double sided nylon sandwich mesh fabric zipper and slider assembly in which the coil strips are left handed and right handed plastic coils each having a center cord and a series of interlocking teeth, each tooth having a tooth head and a tooth body so configured that the tooth heads of the teeth of the coil strips at one zipper tape are respectively interlockable with the tooth heads of the teeth of the coil strips at the other zipper tape; the slider has C-shaped guide grooves defined in upper and lower chambers therein to guide horizontal movement of the teeth of the upper and lower coil strips smoothly between locking and unlocking positions, and a balance guide block protruded from the central partition plate thereof and configured to match with the configuration of the tooth heads of the interlocking teeth of the coil strips, facilitating accurate alignment between the left and right teeth of the upper and lower coil strips and assuring smooth engagement and disengagement of the interlocking teeth.

2. Description of the Related Art

Nylon zippers are intensively used in garments, cases, bags and many other accessories. Following increasing in economic activity and competition, users need more about zipper's applicability and special functions. Conventional zipper designs can no longer satisfy clients' requirements and expectation, such as: strength enhancement, prevention of malengagement, waterproof feature, anti-bacteria, safety enhancement, environmental protection, and etc. Conventional nylon zippers are commonly of single side design, comprising two zipper tapes, and two series of interlocking teeth respectively fastened to the respective top walls of the zipper tapes with stitches. Further, Taiwan Patent Number 441257 & China Patent Number ZL00233580.8 discloses a nylon zipper structure, entitled "Improvement of nylon zipper tape" (see FIGS. 1~3). According to this design, each lateral side 701 of the center cord 70 of each coil strip is kept away from the tooth head 711 of the associating series of interlocking teeth 71 (see FIG. 3). Thus, when fastening the coil strips to the zipper tapes all together, the stitching action of the needle may stitch the interlocking teeth, causing stitching problems. To avoid this problem, each coil strip 7 is separately stitched to one respective zipper tape 8, and then the two zipper tapes 8 with the respective stitched coil strips 7 are fastened together. However, this method is complicated. Further, because the two coil strips 7 are respectively and separately stitched to the respective zipper tapes 8, the stitch seams that secure the respective coil strips to the respective zipper tapes may be not kept perfectly in parallel, in consequence, the teeth of the two coil strips may be not accurately aligned for smooth engagement and disengagement. Further, as the teeth of the two coil strips are not accurately aligned, the H-shaped guide grooves 91 in the upper and lower chambers inside the slider 9 may be unable to guide the teeth of the two coil strips into positive engagement, leading to protruding teeth and malengagement. This problem will be more serious when the slider is being moved to a turning corner area.

SUMMARY OF THE INVENTION

The present invention has been accomplished under the circumstances in view. It is the main object of the present invention to provide a double sided nylon sandwich mesh fabric zipper and slider assembly, which eliminates the drawbacks of the prior art design.

To achieve this and other objects of the present invention, the center cord of each of the upper and lower coil strips of the double sided nylon sandwich mesh fabric zipper and slider assembly is squeezed into a flat or elliptical columnar shape with its one side edge kept in contact with the tooth heads of the series of interlocking teeth, facilitating mounting of the slider. When fastening up the interlocking teeth of the upper and lower coil strips, the tooth heads of the series of interlocking teeth of the upper and lower coil strips are positively interlocked, avoiding loosening.

Further, when fastening the upper and lower coil strips to the left and right zipper tapes, a specially designed throat plate is used. At this time, the upper and lower coil strips are respectively inserted into the upper positioning groove and lower positioning groove of the throat plate, the left and right zipper tapes are respectively inserted into the left positioning groove and right positioning groove of the throat plate for stitching accurately and steadily at one time by means of the functioning of a step motor, enhancing stitching reliability.

Further, the rear part of the cylindrical neck portion of the tooth body of each individual tooth of the upper and lower coil strips is thermally molded into a depressed surface area and two expanded flanges at two opposite lateral sides of the depressed surface area for enhancing engagement tightness between the mating tooth heads. When an external pointed object is accidentally inserted into the upper or lower coil strip, only the limited small gap (about 0.3 mm) between the stitch seam and the flanges will receive the tip of the pointed object. When the tip of the pointed object is forced downwardly forwards, the mating tooth heads are interlocked, the flange of the tooth at one side is forced slightly outwards and stopped against the tooth head of the mating tooth at the opposite side, and therefore the tooth head of the tooth at one side (left or right side) is stopped by the flanges of the mating teeth at the opposite side (right or left side) and prohibited from leftward or rightward displacement, avoiding breaking of the engagement between the interlocking teeth of the upper and lower coil strips.

Further, the fabric slits are disposed on the middle between the internal upper and lower chambers of the slider. Further, C-shaped guide grooves are respectively and bilaterally formed in the top guard plate and the bottom guard plate of the slider to fit the arched configuration of the teeth. Thus, when the zipper tapes are inserted through the internal upper and lower chambers between the opposing top guard plate and bottom guard plate of the slider, the C-shaped guide grooves guide the teeth of the upper and lower coil strips to move horizontally forwards or backwards, facilitating smooth engagement and disengagement in a turning corner area.

Further, the central partition plate of the slider that joins the top guard plate and the bottom guard plate comprises a balance guide block and a plurality of guide grooves bilaterally located on the balance guide block and configured to match with the configuration of the tooth heads of the interlocking teeth of the upper and lower coil strips, facilitating accurate alignment between the left and right teeth of the upper and lower coil strips and assuring smooth engagement and disengagement of the interlocking teeth.

DETAILED DESCRIPTION OF THE INVENTION

Figure 9:
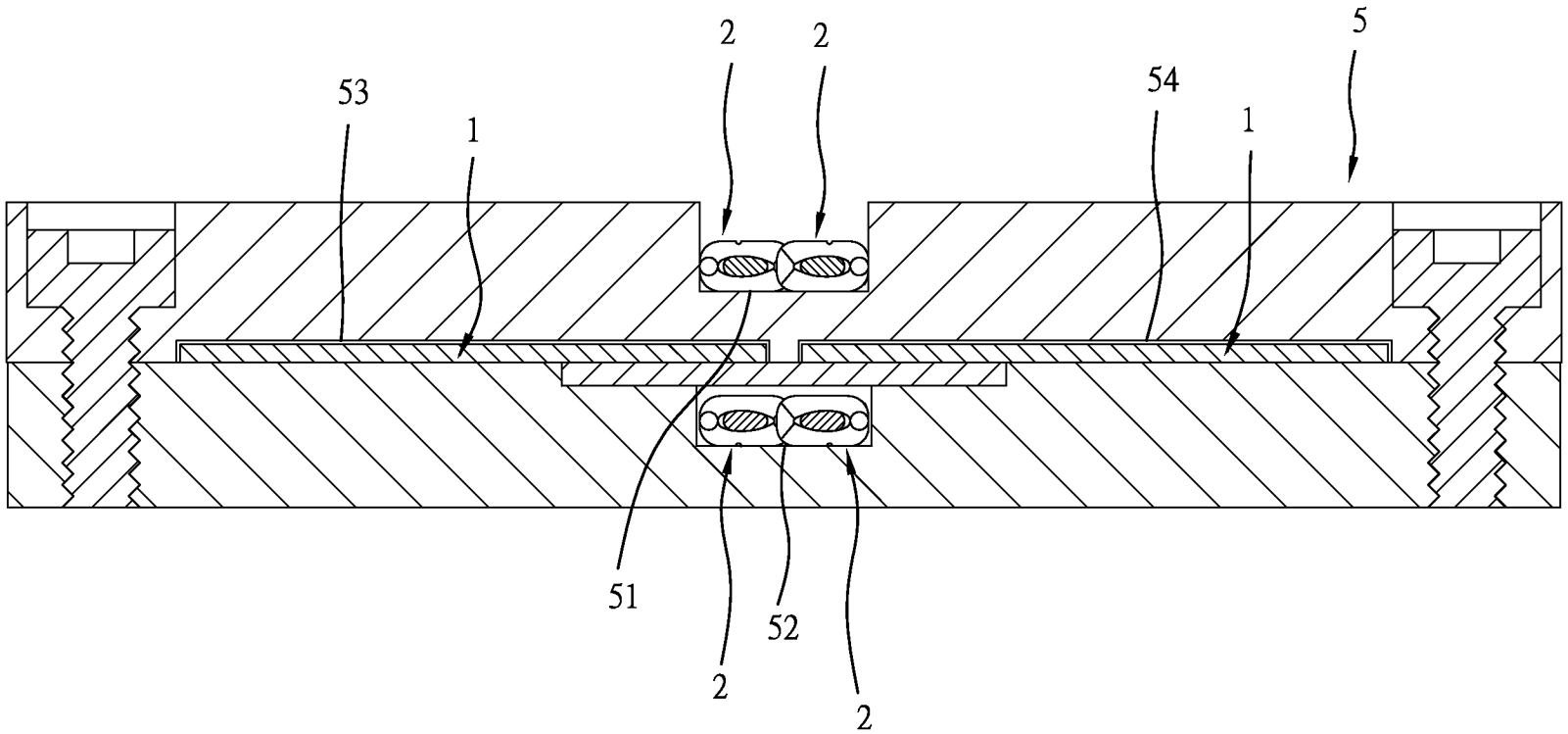
FIG. 9 is a schematic sectional view of the present invention, illustrating the zipper tapes and the upper and lower coil strips respectively put in the specially designed throat plate before stitching.
Figure 10:
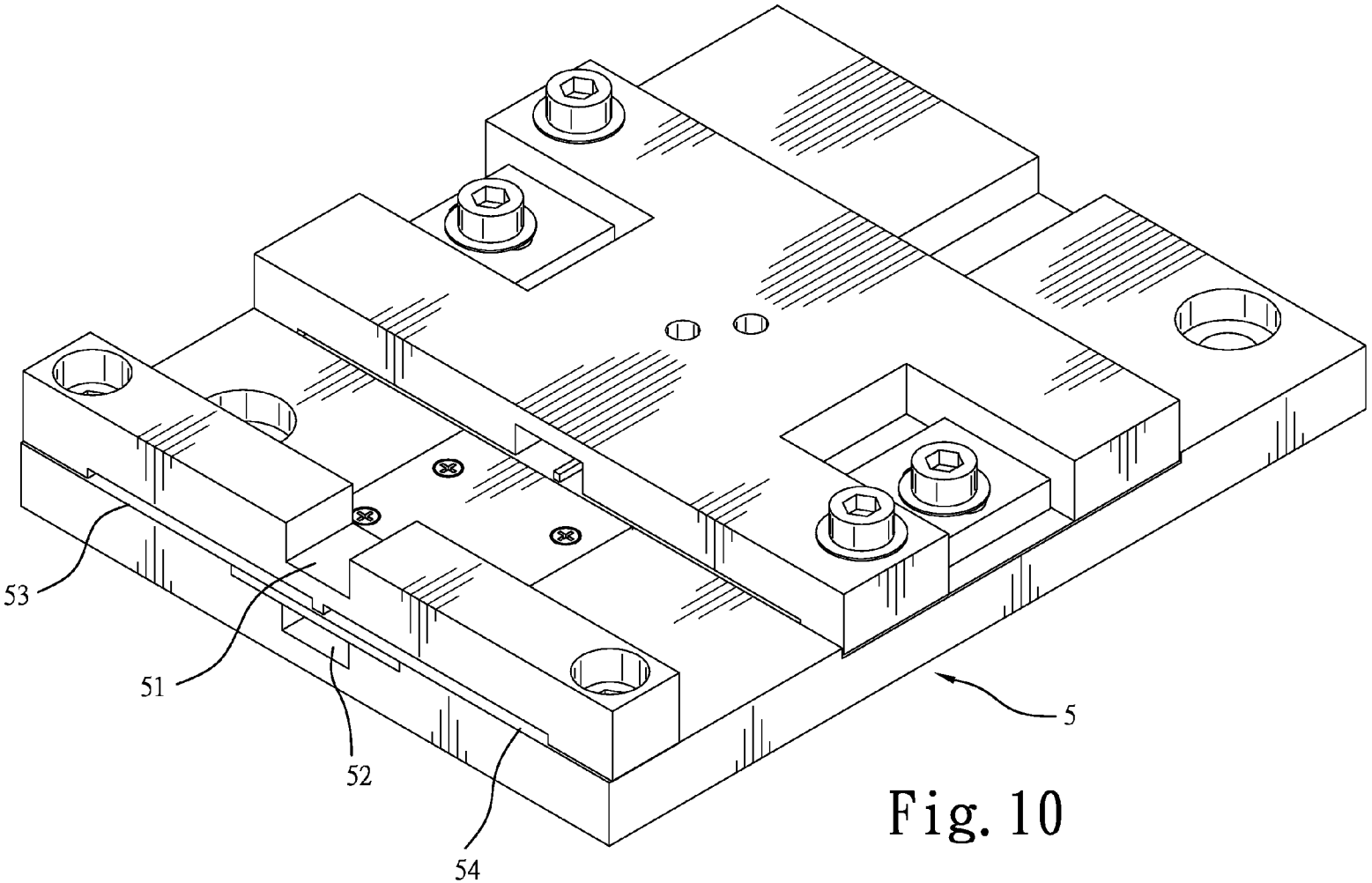
FIG. 10 is an elevational view of the throat plate shown in FIG. 9.
Figure 11:
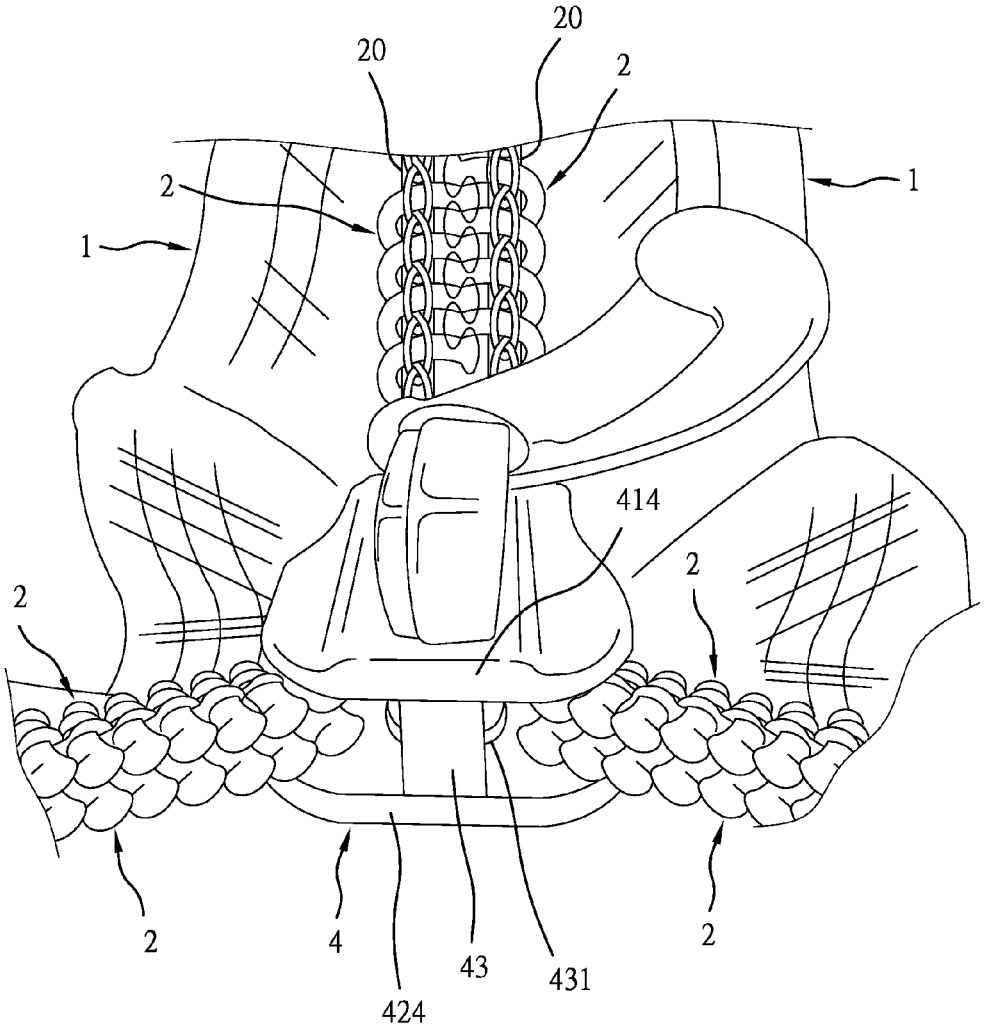
FIG. 11 is a schematic drawing illustrating the outer appearance of double sided nylon sandwich mesh fabric zipper and slider assembly in accordance with the first embodiment of the present invention.

Referring to FIGS. 3~8 and FIG. 11, a double sided nylon sandwich mesh fabric zipper and slider assembly in accordance with a first embodiment of the present invention is shown consisting of a double sided nylon sandwich mesh fabric zipper and a slider. The double sided nylon sandwich mesh fabric zipper comprises opposing left and right zipper tapes 1, and upper and lower coil strips 2 respectively stitched to opposing top and bottom sides of each of the two opposing left and right zipper tapes 1. The upper and lower coil strips 2 are left handed and right handed plastic coils, each comprising a center cord 20 and a series of interlocking teeth 21 (see FIG. 4). Each individual tooth 21 of the series of interlocking teeth 21 (see FIGS. 4 and 5) comprises a tooth head 211 and a tooth body 212. The tooth head 211 and the tooth body 212 are so configured that the tooth heads 211 of the series of interlocking teeth 21 of the upper and lower coil strips 2 at one of the two opposing left and right zipper tapes 1 are respectively interlockable with the tooth heads 211 of the series of interlocking teeth 21 of the upper and lower coil strips 2 at the other of the two opposing left and right zipper tapes 1 (see FIG. 5). During formation of the upper/lower coil strip 2, a plastic material is molded on the center cord 20 by means of left/right screw motion, forming the desired series of interlocking teeth 21 that have a substantially rectangular profile (see FIG. 4). During the left/right screw motion, the round center cord 20 is compressed into an elliptical columnar shape (see FIG. 4), having its one side edge 201 kept in contact with the tooth heads 211 of the series of interlocking teeth 21 to give support. Subject to the support of the side edges 201 of the respective round center cords 20, the tooth heads 211 of the series of interlocking teeth 21 of the upper and lower coil strips 2 at one of the two opposing left and right zipper tapes 1 can be accurately an positively interlocked with the tooth heads 211 of the series of interlocking teeth 21 of the upper and lower coil strips 2 at the other of the two opposing left and right zipper tapes 1. When fastening the upper and lower coil strips 2 to the left and right zipper tapes 1, a specially designed throat plate 5 is used (see FIGS. 9 and 10). At this time, the upper and lower coil strips 2 are respectively inserted into the upper positioning groove 51 and lower positioning groove 52 of the throat plate 5, the left and right zipper tapes 1 are respectively inserted into the left positioning groove 53 and right positioning groove 54 of the throat plate 5 for stitching accurately and steadily at one time. Technically, one false step will make a great difference. The center cord 20 is made by twisting coarse threads into shape. By means of the functioning of the equal pitch double screw structure of the zipper teeth making machine (not shown), the series of interlocking teeth 21 thus made have a substantially rectangular profile (see FIGS. 4 and 5). At the same time, the center cord 20 is squeezed into a flat or elliptical columnar shape with its one side edge 201 kept in contact with the tooth heads 211 of the series of interlocking teeth 21, facilitating mounting of the slider 4 (see FIG. 5). When fastening up the interlocking teeth 21 of the upper and lower coil strips 2, the tooth heads 211 of the series of interlocking teeth 21 of the upper and lower coil strips 2 are positively interlocked, avoiding loosening. Subject to the aforesaid features and arrangement, the upper and lower coil strips 2 and the left and right zipper tapes 1 can be accurately fastened together with stitches (see FIGS. 9 and 10), assuring a high level of product quality.

Figure 1:
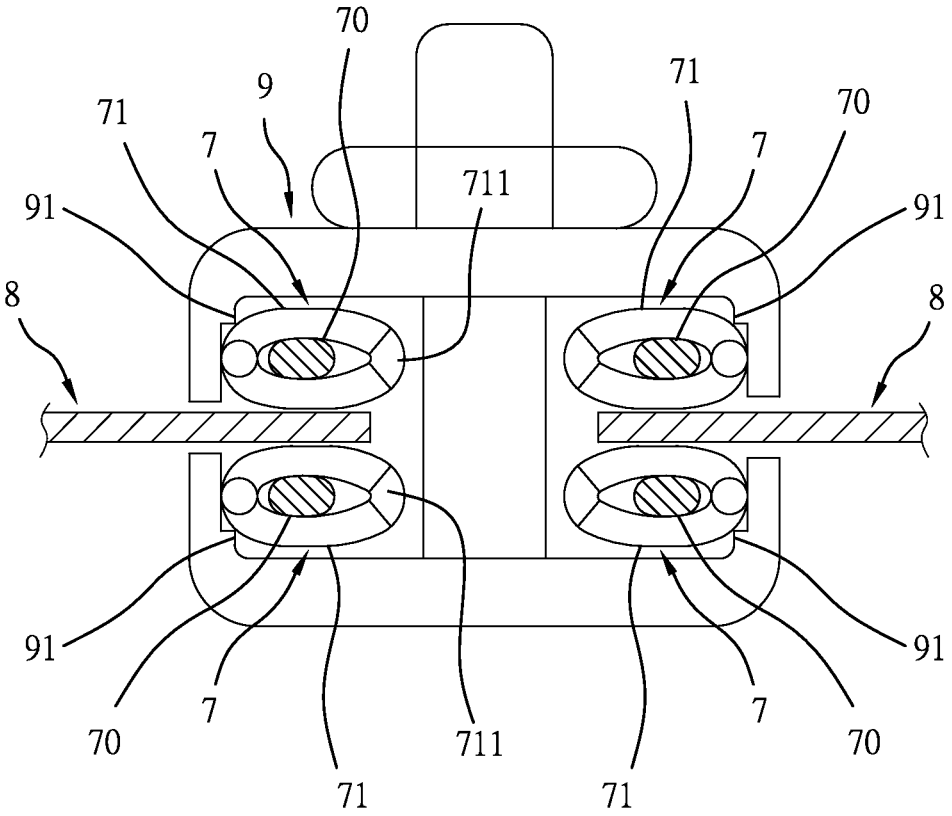
Fig. 1 PRIOR ART
FIG. 1 is a schematic partial sectional view of a double sided nylon zipper and slider assembly according to the prior art.
Figure 2:
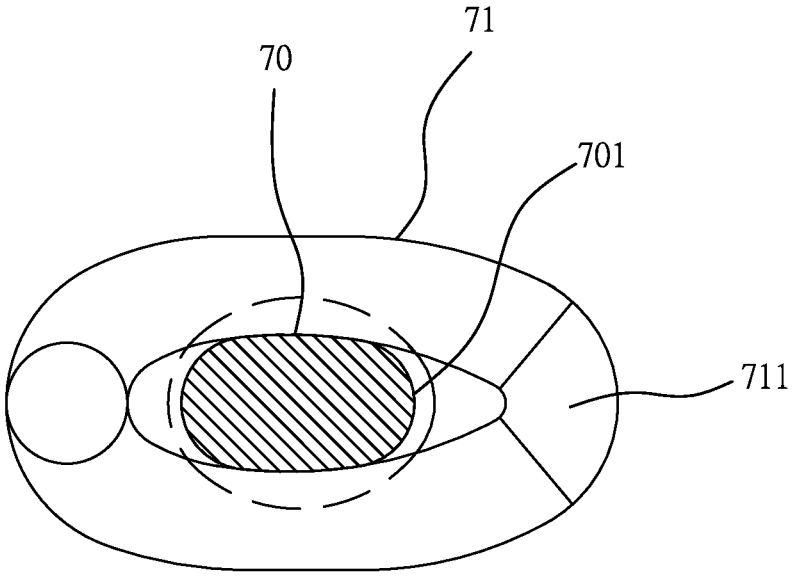
Fig. 2 PRIOR ART
FIG. 2 is an enlarged view of a part of FIG. 1.
Figure 3:
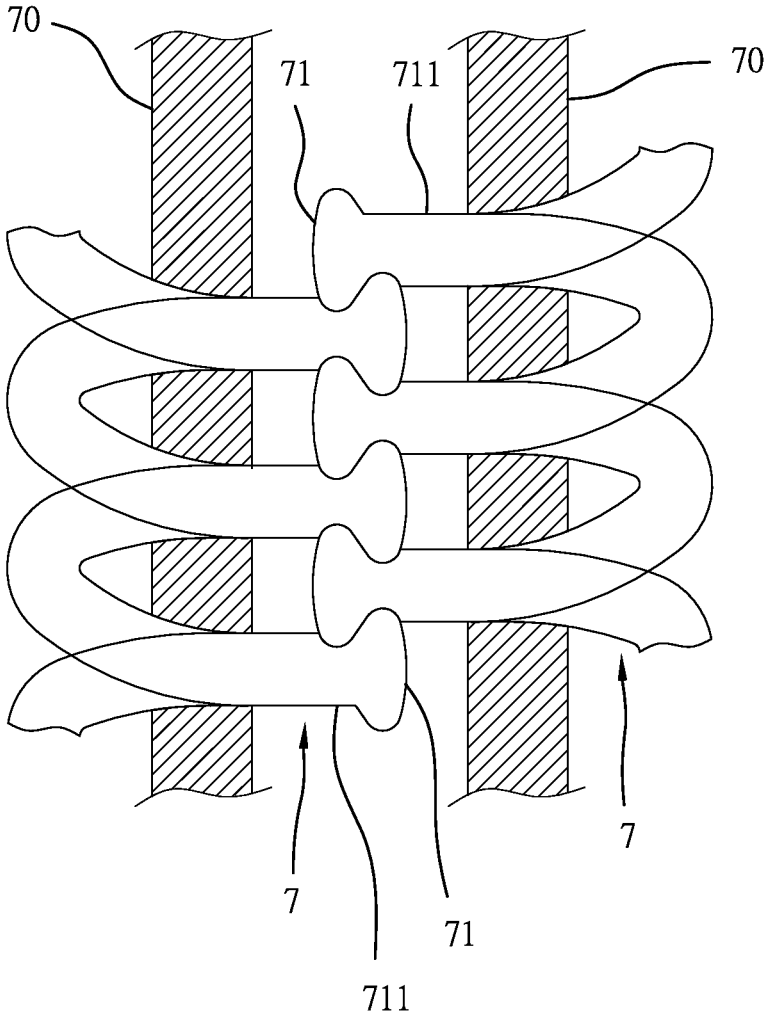
Fig. 3 PRIOR ART
FIG. 3 is another schematic partial sectional view of the double sided nylon zipper and slider assembly according to the prior art when viewed from another angle.
Figure 4:
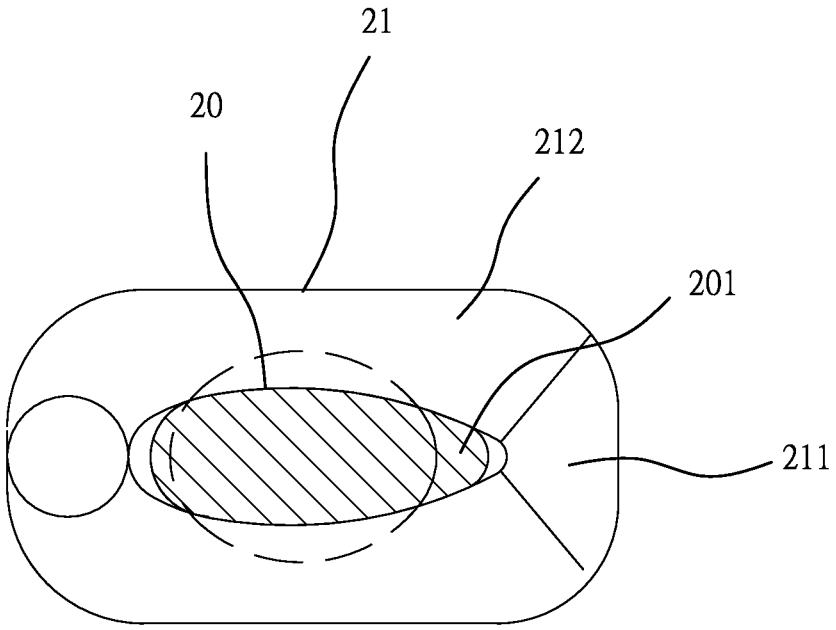
FIG. 4 is a schematic partial sectional view of a double sided nylon zipper and slider assembly in accordance with a first embodiment of the present invention.
Figure 5:
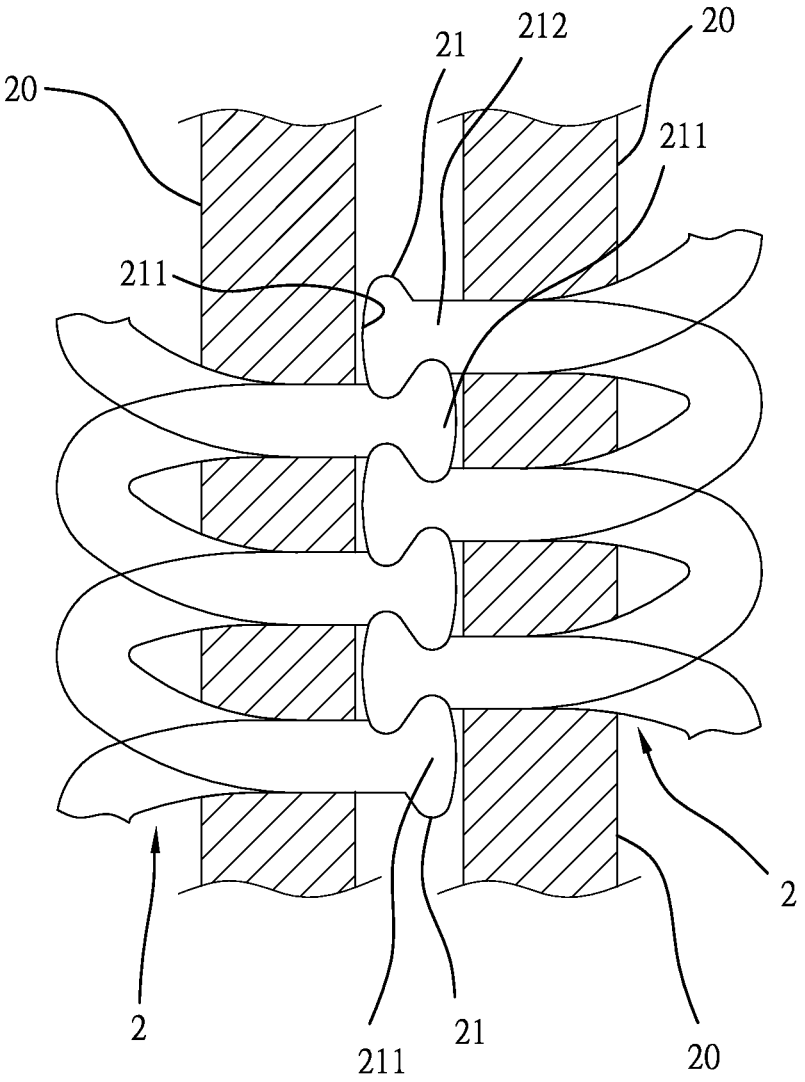
FIG. 5 is a schematic partial sectional view of the double sided nylon zipper and slider assembly in accordance with the first embodiment of the present invention when viewed from another angle.
Figure 6:
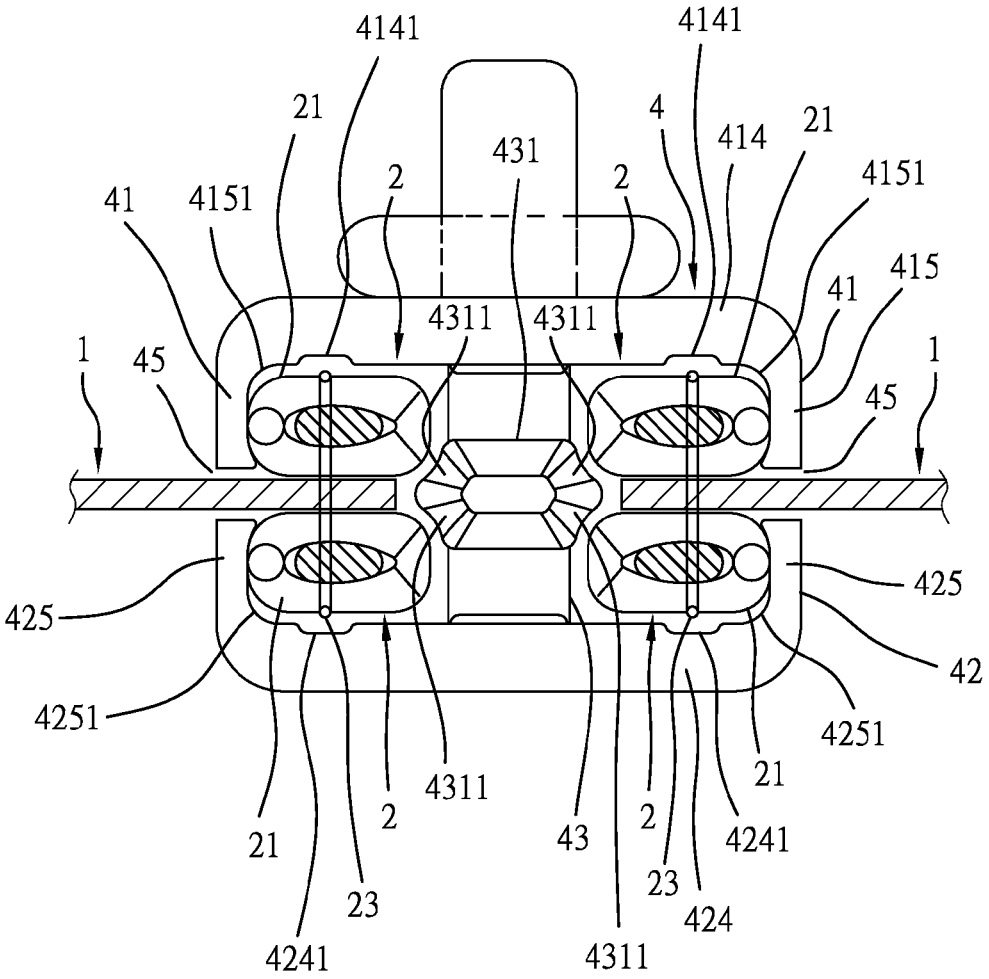
FIG. 6 is another schematic partial sectional view of the double sided nylon zipper and slider assembly in accordance with the first embodiment of the present invention.
Figure 7:
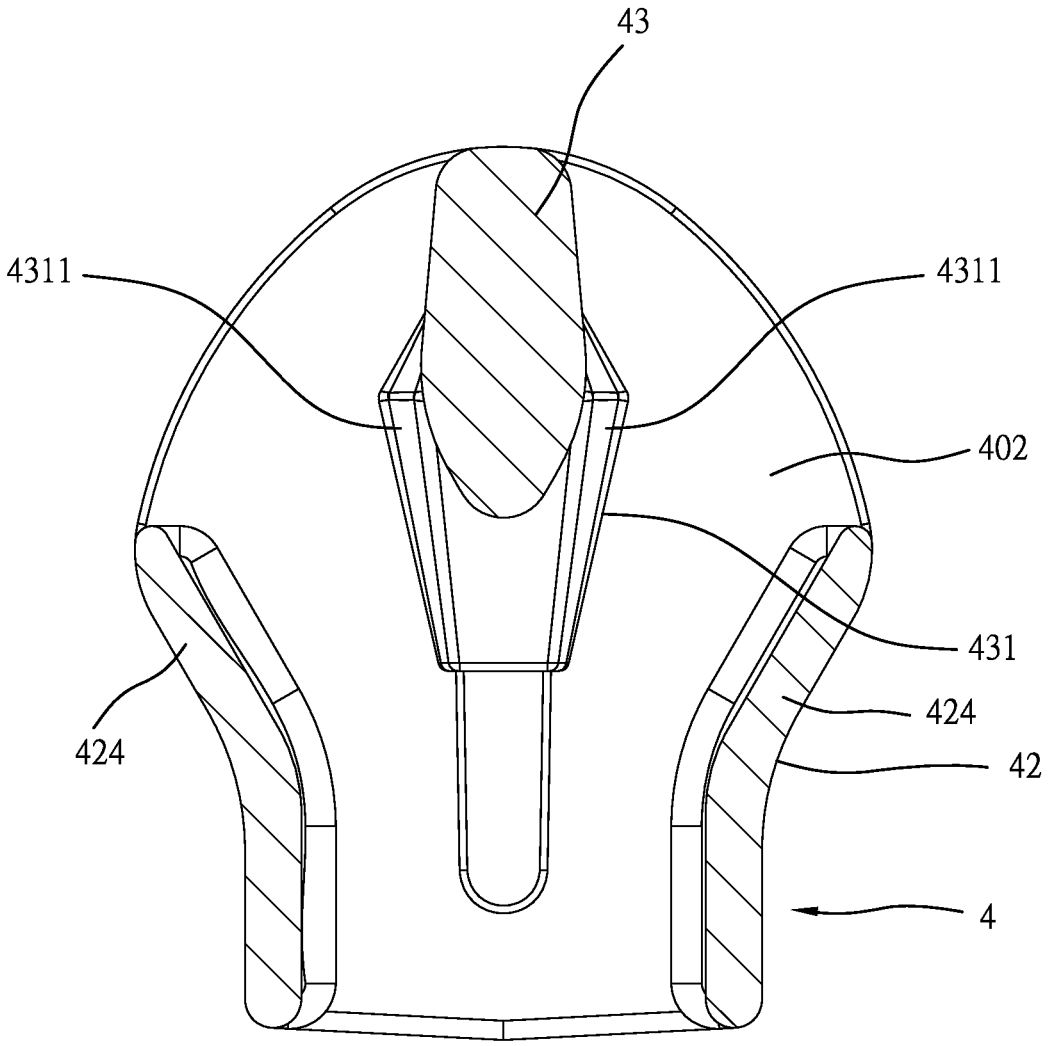
FIG. 7 is a schematic sectional top view of the slider of the double sided nylon zipper and slider assembly in accordance with the first embodiment of the present invention.
Figure 8:
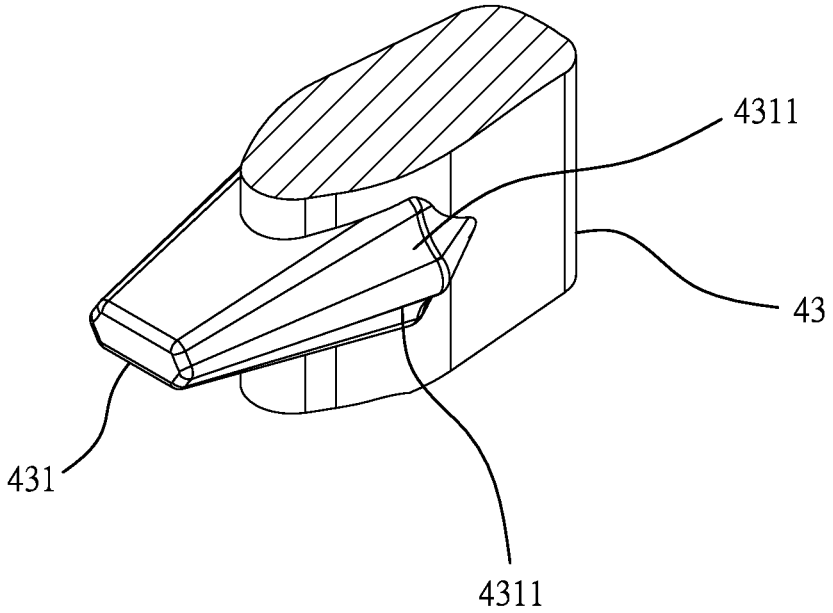
FIG. 8 is a sectional elevation of a part of the slider of the double sided nylon zipper and slider assembly in accordance with the first embodiment of the present invention, illustrating the configuration of the balance guide block.

Further, during formation of the series of interlocking teeth 21, the front end of each tooth 21 is stamped into a tooth head 211; the flexibility of the rear end of each tooth 21 has not been eliminated, and therefore the rear end of each tooth 21 remains arched. To fit double sided zipper design, the fabric slits, referenced by 45, are disposed on the middle between the internal upper and lower chambers of the slider 4 (see FIG. 4) instead of the position in the bottom guard plate for single side zipper. To avoid misalignment and malengagement between the upper and lower coil strips 2 in the internal upper and lower chambers between the opposing top guard plate 41 and bottom guard plate 42 of the slider 4 when the slider 4 is been moved to a turning corner area in a case, bag or tent, the internal upper and lower chambers between the opposing top guard plate 41 and bottom guard plate 42 of the slider 4 when the slider 4 are C-shaped configured, i.e., C-shaped guide grooves 4151 and 4251 are respectively and bilaterally formed in the top guard plate 41 and the bottom guard plate 42 to fit the arched configuration of the teeth 21 (see FIG. 6) where the C-shaped guide grooves 4151 are bilaterally disposed in the upper chamber surrounded by the top wall 414 and two opposing sidewalls 415 of the top guard plate 41; the C-shaped guide grooves 4251 are bilaterally disposed in the lower chamber surrounded by the bottom wall 424 and two opposing sidewalls 425 of the bottom guard plate 42. Thus, when the zipper tapes are inserted through the internal upper and lower chambers between the opposing top guard plate 41 and bottom guard plate 42 of the slider 4, the C-shaped guide grooves 4151 and 4251 guide the teeth 21 of the upper and lower coil strips 2 to move horizontally forwards or backwards, facilitating smooth engagement and disengagement in a turning corner area. Further, as shown in FIG. 6, escape grooves 4141 and 4241 are respectively formed in the top wall 414 of the top guard plate 41 and the bottom wall 424 of the bottom guard plate 42 of the slider 4 for the passing of the seam stitches 23 that secure the upper and lower coil strips 2 to the left and right zipper tapes 1, avoiding friction.

Further, the central partition plate 43 of the slider 4 that joins the top guard plate 41 and the bottom guard plate 42 comprises a balance guide block 431 and a plurality of guide grooves 4311 on the balance guide block 431 (see FIGS. 6, 7 and 8) configured to match with the configuration of the tooth heads 211 of the interlocking teeth 21 of the upper and lower coil strips 2, facilitating accurate alignment between the left and right teeth 21 of the upper and lower coil strips 2 and assuring smooth engagement and disengagement of the interlocking teeth 21.

Figure 12:
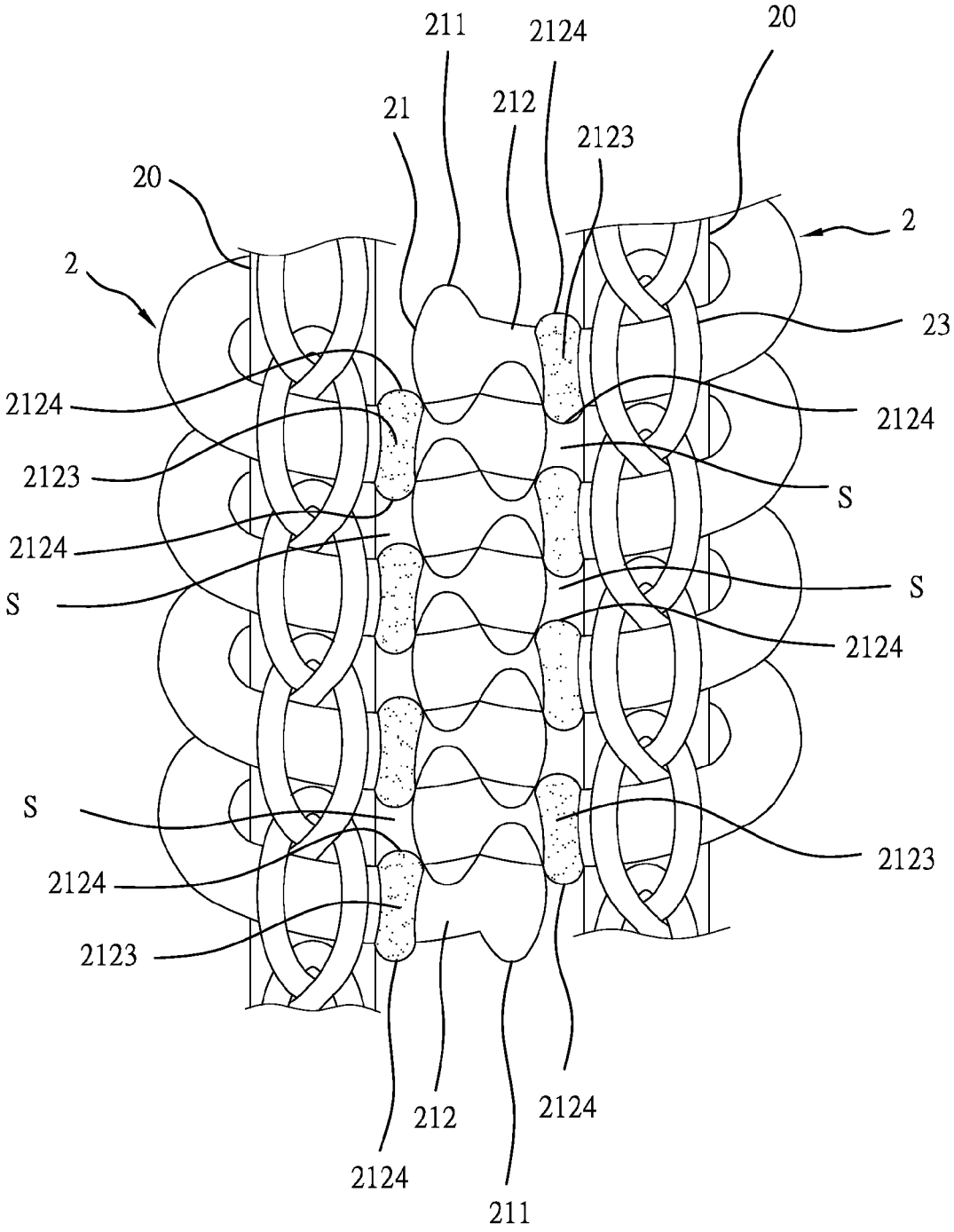
FIG. 12 is a schematic plain view of a double sided nylon sandwich mesh fabric zipper and slider assembly in accordance with a second embodiment of the present invention.
Figure 13:
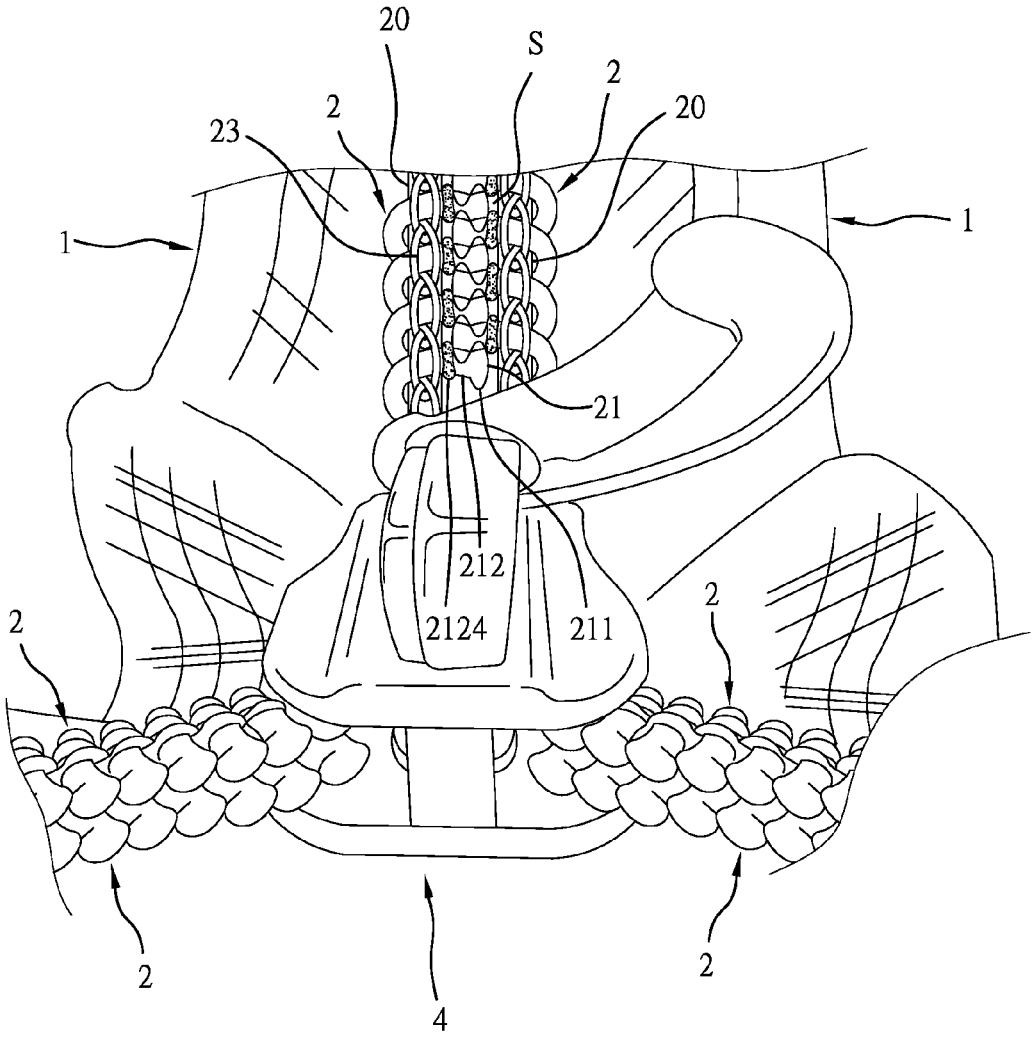
FIG. 13 is a schematic drawing illustrating the outer appearance of double sided nylon sandwich mesh fabric zipper and slider assembly in accordance with the second embodiment of the present invention.

Further, FIGS. 12 and 12 illustrate a double sided nylon sandwich mesh fabric zipper and slider assembly in accordance with a second embodiment of the present invention. This second embodiment enhances fastening tightness and improves the product quality. After stitching or after stitching and dying of the double sided nylon sandwich mesh fabric zipper and slider assembly, a thermal molding technique is employed to the interlocking teeth 21 of the upper and lower coil strips 2. As illustrated in FIGS. 12 and 13, the double sided nylon sandwich mesh fabric zipper comprises opposing left and right zipper tapes 1, and upper and lower coil strips 2 respectively fastened to opposing top and bottom sides of each of the two opposing left and right zipper tapes 1 with seam stitches 23. The upper and lower coil strips 2 are left handed and right handed plastic coils, each comprising a center cord 20 and a series of interlocking teeth 21. Each individual tooth 21 of the series of interlocking teeth 21 comprises a tooth head 211 and a tooth body 212. The tooth head 211 and the tooth body 212 are so configured that the tooth heads 211 of the series of interlocking teeth 21 of the upper and lower coil strips 2 at one of the two opposing left and right zipper tapes 1 are respectively interlockable with the tooth heads 211 of the series of interlocking teeth 21 of the upper and lower coil strips 2 at the other of the two opposing left and right zipper tapes 1. The thermal molding location is at the rear part of the neck portion of the tooth body 212 behind the tooth head 211 of each individual tooth 21 that is originally cylindrical. During thermal molding, the cylindrical neck portion of the tooth body 212 is compressed and deformed, forming a depressed surface area 2123 and two expanded flanges 2124 at two opposite lateral sides of the depressed surface area 2123 for enhancing engagement tightness between the mating tooth heads 211. Referring to FIG. 12 again, when an external pointed object (such as ballpoint pen) is accidentally inserted into the upper or lower coil strip 2, only the limited small gap S (about 0.3 mm) between the stitch seam 23 and the flanges 2124 will receive the tip of the pointed object. When the tip of the pointed object is forced downwardly forwards, the mating tooth heads 211 are interlocked, the flange 2124 of the tooth 21 at one side is forced slightly outwards and stopped against the tooth head 211 of the mating tooth 21 at the opposite side, and therefore the tooth head 211 of the tooth 21 at one side (left or right side) is stopped by the flanges 2124 of the mating teeth 21 at the opposite side (right or left side) and prohibited from leftward or rightward displacement, avoiding breaking of the engagement between the interlocking teeth 21 of the upper and lower coil strips 2. The structure of the slider 4 of this second embodiment is same as the aforesaid first embodiment, and therefore no further detailed description in this regard is necessary.

In conclusion, the invention provides a double sided nylon sandwich mesh fabric zipper and slider assembly, which has advantages and features as follows:

1. The center cord 20 is squeezed into a flat or elliptical columnar shape with its one side edge kept in contact with the tooth heads 211 of the series of interlocking teeth 21, facilitating mounting of the slider 4. When fastening up the interlocking teeth 21 of the upper and lower coil strips 2, the tooth heads 211 of the series of interlocking teeth 21 of the upper and lower coil strips 2 are positively interlocked, avoiding loosening.

2. When fastening the upper and lower coil strips 2 to the left and right zipper tapes 1, a specially designed throat plate 5 is used. At this time, the upper and lower coil strips 2 are respectively inserted into the upper positioning groove 51 and lower positioning groove 52 of the throat plate 5, the left and right zipper tapes 1 are respectively inserted into the left positioning groove 53 and right positioning groove 54 of the throat plate 5 for stitching accurately and steadily at one time by means of the functioning of a step motor, enhancing stitching reliability.

3. By means of increasing the warp density and weft density of a conventional plain weaving fabric, the transverse tensile strength of the zipper tapes is enhanced and can be in the range of 100-300 $kg/mm^2$ 4. The fabric slits 45 are disposed on the middle between the internal upper and lower chambers of the slider 4; C-shaped guide grooves 4151 and 4251 are respectively and bilaterally formed in the top guard plate 41 and the bottom guard plate 42 to fit the arched configuration of the teeth 21. Thus, when the zipper tapes are inserted through the internal upper and lower chambers between the opposing top guard plate 41 and bottom guard plate 42 of the slider 4, the C-shaped guide grooves 4151 and 4251 guide the teeth 21 of the upper and lower coil strips 2 to move horizontally forwards or backwards, facilitating smooth engagement and disengagement in a turning corner area.

5. The central partition plate 43 of the slider 4 that joins the top guard plate 41 and the bottom guard plate 42 comprises a balance guide block 431 and a plurality of guide grooves 4311 bilaterally located on the balance guide block 431 and configured to match with the configuration of the tooth heads 211 of the interlocking teeth 21 of the upper and lower coil strips 2, facilitating accurate alignment between the left and right teeth 21 of the upper and lower coil strips 2 and assuring smooth engagement and disengagement of the interlocking teeth 21.

6. The rear part of the cylindrical neck portion of the tooth body 212 of each individual tooth 21 is thermally molded into a depressed surface area 2123 and two expanded flanges 2124 at two opposite lateral sides of the depressed surface area 2123 for enhancing engagement tightness between the mating tooth heads 211 (see FIG. 12). When an external pointed object is accidentally inserted into the upper or lower coil strip 2, only the limited small gap S (about 0.3 mm) between the stitch seam 23 and the flanges 2124 will receive the tip of the pointed object. When the tip of the pointed object is forced downwardly forwards, the mating tooth heads 211 are interlocked, the flange 2124 of the tooth 21 at one side is forced slightly outwards and stopped against the tooth head 211 of the mating tooth 21 at the opposite side, and therefore the tooth head 211 of the tooth 21 at one side (left or right side) is stopped by the flanges 2124 of the mating teeth 21 at the opposite side (right or left side) and prohibited from leftward or rightward displacement, avoiding breaking of the engagement between the interlocking teeth 21 of the upper and lower coil strips 2. The structure of the slider 4 of this second embodiment is same as the aforesaid first embodiment, and therefore no further detailed description in this regard is necessary.

While only few embodiment of the present invention have been shown and described, it will be understood that various modifications and changes could be made thereunto without departing from the spirit and scope of the invention disclosed.

What is claimed is:

1. A double sided nylon sandwich mesh fabric zipper and slider assembly, said double sided nylon sandwich mesh fabric zipper comprising opposing left and right zipper tapes and upper and lower coil strips respectively stitched to opposing top and bottom sides of each of said two opposing left and right zipper tapes, wherein said upper and lower coil strips are left handed and right handed plastic coils, each comprising a center cord and a series of interlocking teeth, each tooth of said series of interlocking teeth having a substantially rectangular profile and comprising a tooth head and a tooth body, said tooth head and said tooth body configured that the tooth heads of said series of interlocking teeth of said upper and lower coil strips at one of said two opposing left and right zipper tapes are respectively interlockable with the tooth heads of the series of interlocking teeth of said upper and lower coil strips at the other of said two opposing left and right zipper tapes, said slider comprises a top guard plate, a bottom guard plate, a central partition plate connected between said top guard plate and said bottom guard plate and comprising a balance guide block and a plurality of guide grooves symmetrically bilaterally located on said balance guide block and configured to match with the configuration of the tooth heads of said interlocking teeth of said upper and lower coil strips, said top guard plate comprising a top wall, two opposing sidewalls, an upper chamber surrounded by the top wall and two opposing sidewalls of said top guard plate and two C-shaped guide grooves bilaterally formed in said upper chamber and configured to fit the configuration of said series of interlocking teeth of said upper and lower coil strips, and two escape grooves formed on the top wall of the top guard plate, said bottom guard plate comprising a bottom wall, two opposing sidewalls, a lower chamber surrounded by the bottom wall and two opposing sidewalls of said bottom guard plate and two C-shaped guide grooves bilaterally formed in said lower chamber and configured to fit the configuration of said series of interlocking teeth of said upper and lower coil strips and two escape grooves formed on the bottom wall of the bottom guard plate.

2. The double sided nylon sandwich mesh fabric zipper and slider assembly as claimed in claim 1, wherein said upper and lower coil strips are respectively stitched to opposing top and bottom sides of each of said two opposing left and right zipper tapes at one time with seam stitches.

* * * * *